US005615742A

United States Patent [19]

Robin et al.

[11] Patent Number: 5,615,742

[45] Date of Patent: Apr. 1, 1997

[54] NONCOMBUSTIBLE HYDROGEN GAS CONTAINING ATMOSPHERES AND THEIR PRODUCTION

[75] Inventors: Mark L. Robin; Charles J. Mazac; John S. Rubacha, all of West Lafayette, Ind.

[73] Assignee: Great Lakes Chemical Corporation, West Lafayette, Ind.

[21] Appl. No.: 528,734

[22] Filed: Sep. 15, 1995

Related U.S. Application Data

[63] Continuation-in-part of Ser. No. 434,157, May 3, 1995, abandoned.

[51] Int. Cl.[6] ..... A62C 2/00; A62C 3/00; A62D 1/00

[52] U.S. Cl. ..... 169/45; 252/2; 252/8; 252/601; 252/372; 252/375; 252/374

[58] Field of Search ..... 252/2, 3, 8, 372, 252/374, 375, 377, 601; 169/45, 46, 47

[56] References Cited

U.S. PATENT DOCUMENTS

| | | | |
|---|---|---|---|
| 3,715,438 | 2/1973 | Huggett | 514/771 |
| 5,084,190 | 1/1992 | Fernandez | 252/8 |
| 5,124,053 | 6/1992 | Iikubo et al. | 252/8 |
| 5,250,200 | 10/1993 | Sallet | 252/8 |
| 5,393,438 | 2/1995 | Fernandez | 252/8 |

OTHER PUBLICATIONS

Ford, Charles L. "Halon 1301 Fire–Extinguishing Agent: Properties and Applications", Fire Journal, Nov. 1970, pp. 36–41.

*Hawley's Condensed Chemical Dictionary*, 11th Ed., Van Nostrand Reinhold Company, N.Y. (1987), Citation For "air", p. 28.

*Primary Examiner*—Joseph D. Anthony

*Attorney, Agent, or Firm*—Woodard, Emhardt, Naughton, Moriarty & McNett

[57] ABSTRACT

A method for extinguishing hydrogen fires comprises introducing to the hydrogen fire a fire extinguishing concentration of 1,1,1,2,3,3,3-heptafluoropropane and maintaining the concentration until the fire is extinguished. The method includes heptafluoropropane at a range of 13–30% volume/volume in the air. The fire extinguishing methods also include the use of heptafluoropropane in blend with other fire extinguishing compounds. Also disclosed are atmospheres of hydrogen, an oxidizer, and a sufficient amount of 1,1,1,2,3,3,3-heptafluoropropane to render the atmosphere incapable of supporting combustion of the hydrogen, as well as related methods for preparing such atmospheres.

13 Claims, 3 Drawing Sheets

Flammability Diagram for the System Hydrogen/Air/HFC-227ea

Ignition Energy: 70 J

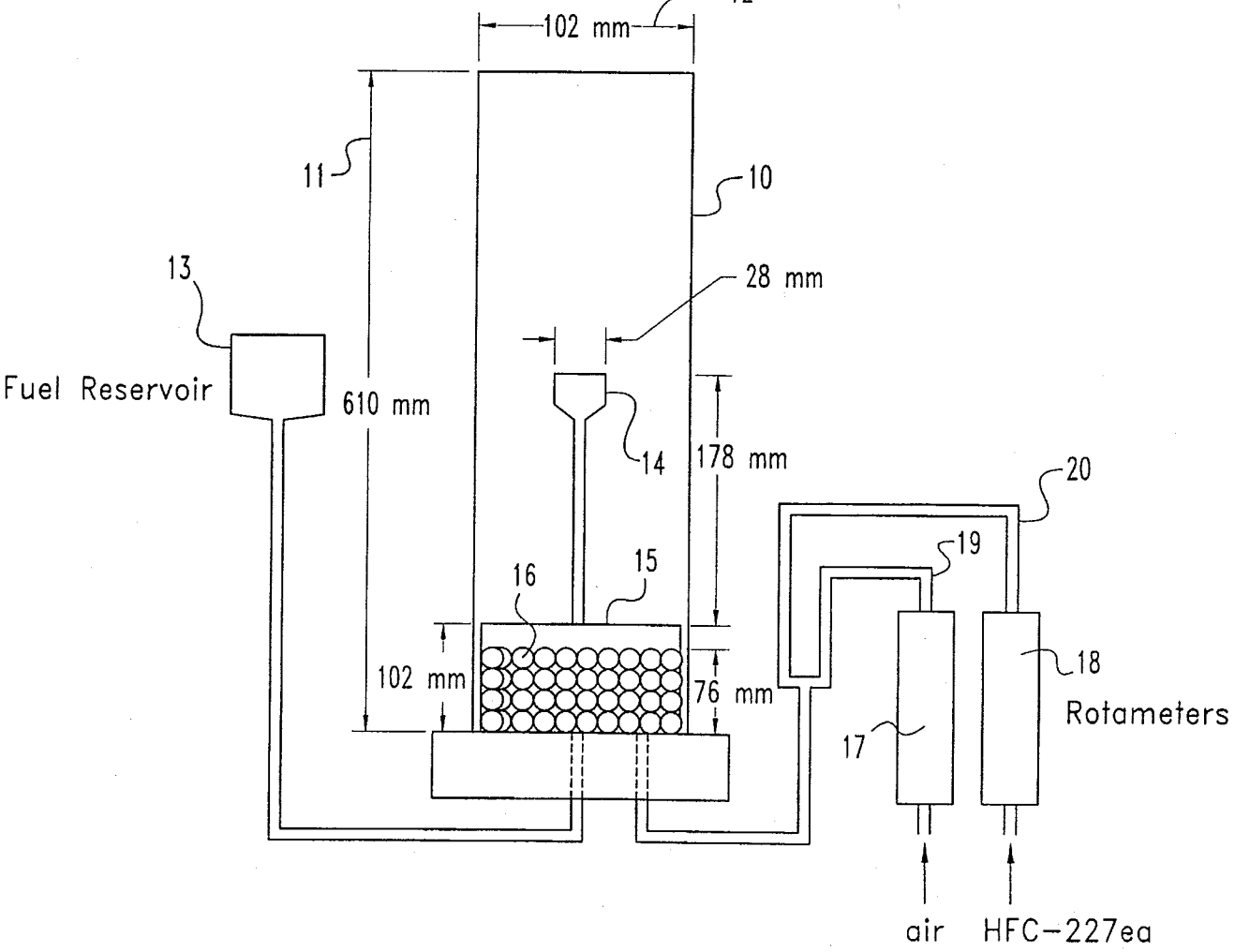
Figure 1. Cup Burner Apparatus

Figure 2: Flammability Diagram for the System Hydrogen/Air/HFC-227ea
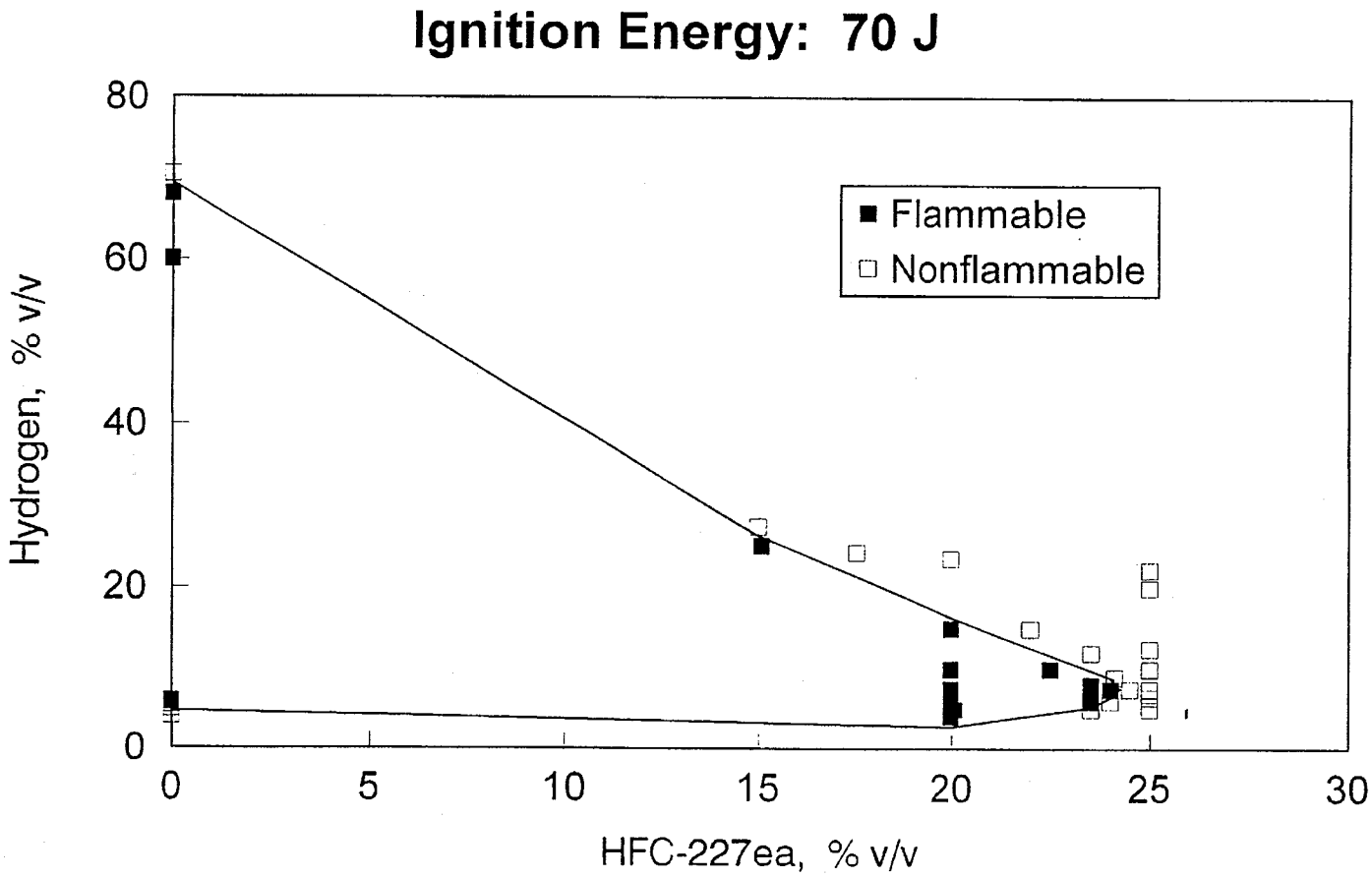

Figure 3: Flammability Diagram for the Hydrogen/Air/Halon 1301 System
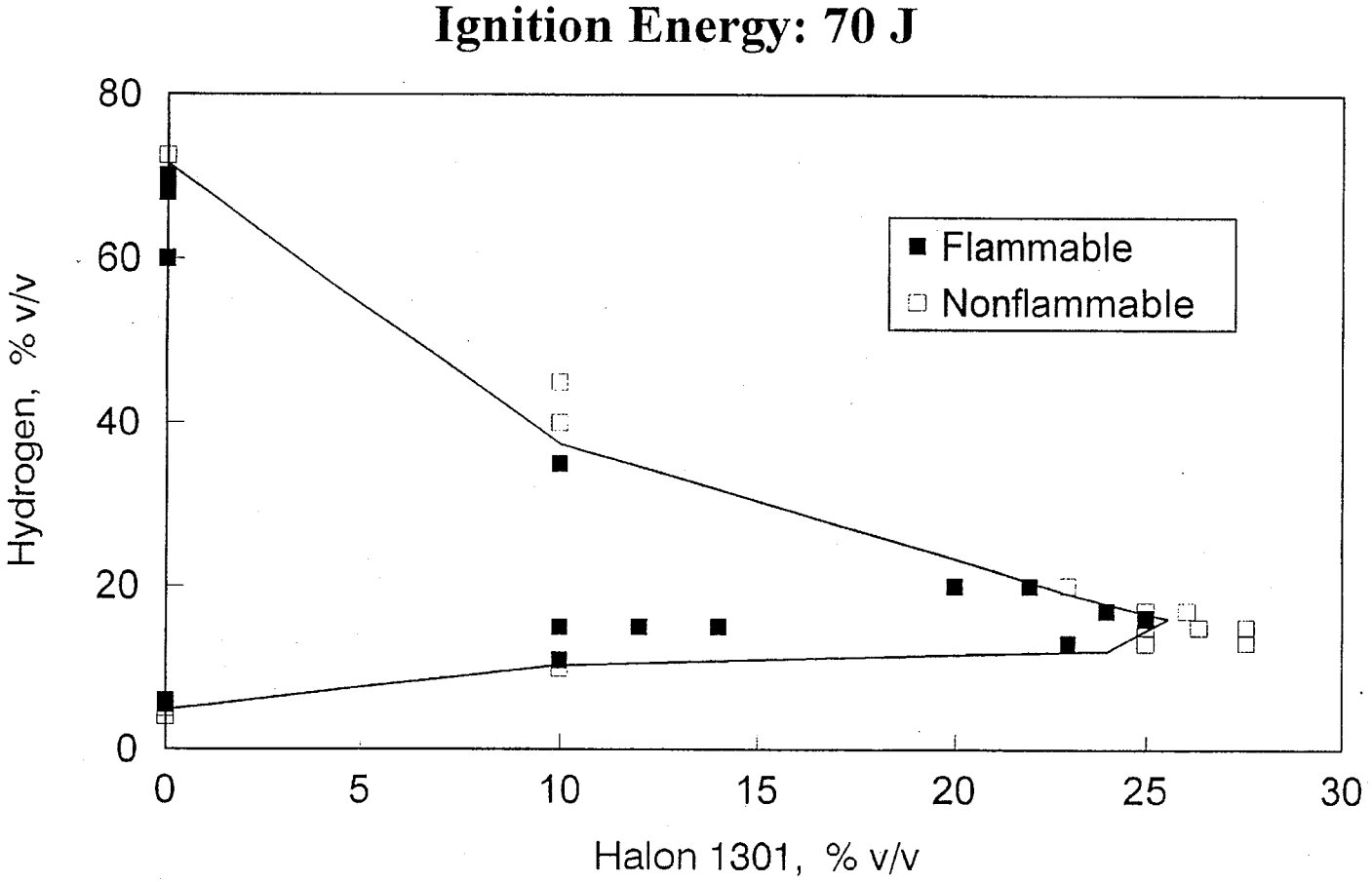

NONCOMBUSTIBLE HYDROGEN GAS CONTAINING ATMOSPHERES AND THEIR PRODUCTION

REFERENCE TO RELATED APPLICATION

This application is a continuation-in-part application of our patent application Ser. No. 08/434,157 filed May 3, 1995, which is now abandoned.

BACKGROUND OF THE INVENTION

1. Field of the Invention

The present invention relates to the protection of hydrogen-containing hazards and the suppression of hydrogen combustion and fires.

2. Description of the Prior Art

The use of certain bromine-containing chemical agents for the extinguishment of fires is common. These agents are in general thought to be effective due to their interference with the normal chain reactions responsible for flame propagation. The most widely accepted mechanism for flame suppression is the radical trap mechanism proposed by Fryburg in "Review of Literature Pertinent to Fire Extinguishing Agents and to Basic Mechanisms Involved in Their Action", NACA-TN 2102 (1950). It is generally accepted that compounds containing the halogens chlorine, bromine and iodine act by interfering with free radical or ionic species in the flame; the presence of fluorine had not been considered as contributing to the fire extinguishing properties of a compound, but will impart stability, reduce toxicity and boiling point and increase thermal stability.

Various halogenated hydrocarbons have been employed as fire extinguishants. Prior to 1945, three halogenated extinguishing agents widely used were carbon tetrachloride, methyl bromide and bromochloromethane. For toxicological reasons, however, the use of these agents has been discontinued. The three fire extinguishing compounds presently in common use are bromine-containing compounds, Halon 1301 ($CF_3Br$), Halon 1211 ($CF_2BrCl$) and Halon 2402 ($BrCF_2CF_2Br$). The effectiveness of these three volatile bromine-containing compounds in extinguishing fires has been described in U.S. Pat. No. 4,014,799, issued to Owens. The National Fire Protection Association (NFPA) publication, *The Fire Protection Handbook,* Section 18, Chapter 2, entitled "Halogenated Agents and Systems" (1985) describes these agents in more detail.

Although the above-named bromine-containing compounds are effective fire fighting agents, those agents containing bromine or chlorine are asserted to be capable of the destruction of the earth's protective ozone layer. For example, Halon 1301 has an Ozone Depletion Potential (ODP) rating of 10, and Halon 1211 has an ODP of 3. As a result of concerns over ozone depletion, the production and sale of these agents after Jan. 1, 1994 is prohibited under international and United States policy.

It is therefore an object of this invention to provide a method for extinguishing fires as rapidly and effectively as the techniques using presently employed Halons while avoiding the above-named drawbacks.

Hydrogen is an important industrial chemical in petroleum refining, in the synthesis of methanol and ammonia, and in the manufacture of various chemicals. Hydrogen also finds use in metallurgical processing, vegetable-oil hydrogenation, electronics manufacture and fuel cell applications (Kirk-Othmer Encyclopedia of Chemical Technology, 5th ed., volume 13). The danger in the use of hydrogen lies in its extreme flammability in oxygen or air. Hydrogen is odorless, colorless, and burns with an almost invisible flame. As a result, hydrogen is not readily detected, further increasing the danger of its use compared to other flammable substances. Detonation and flammability limits for hydrogen are wider than those of most other flammable gases.

The difficulty of suppressing hydrogen combustion and fires is evident from the large quantities of Halons, in particular Halon 1301, required for suppression. Whereas a large selection of Class A and Class B fuels are sufficiently protected by a concentration of 5 percent by volume Halon 1301, suppression of hydrogen fires with Halon 1301 requires at least 20 percent by volume Halon 1301 (C. E. Ford, Halon 1301 Fire-Extinguishing Agent: Properties and Applications, in Fire Protection by Halons, NFPA, 1975.).

It is a further object of this invention to provide an agent for use in a method for the suppression of hydrogen combustion that is efficient, economical and environmentally safe with regard to ozone depletion.

The use of certain bromine-containing chemical agents such as Halon 1301 to provide an inert atmosphere which is incapable of supporting combustion is also known, and such applications are commonly referred to as inerting applications, as opposed to extinguishing applications. In inerting applications an enclosure containing a combustible hazard is filled with sufficient quantities of the inerting agent such that the resulting atmosphere will not support combustion of the otherwise combustible hazard. Hence, even in the case that an ignition source is activated, for example an electric arc or electrostatic spark, combustion does not occur. Inerting applications include explosion suppression and the protection of areas containing combustible and/or flammable materials.

The difficulty of suppressing hydrogen combustion is evident from the large quantities of Halons required for the inertion of hydrogen/air mixtures. Whereas the inertion of a large selection of fuels requires Halon 1211 or Halon 1301 concentrations in the range of 4 to 10 percent by volume, the inertion of hydrogen/air mixtures requires concentrations in excess of 20 percent by volume Halon 1211 or Halon 1301 (C. L. Ford, in Halogenated Fire Suppressants, ACS Symposium Series 16, ACS, 1975.)

It is a further object of this invention to provide an atmosphere which does not support the combustion of hydrogen that is efficient, economical and environmentally safe with regard to ozone depletion.

SUMMARY OF THE INVENTION

Briefly describing one aspect of the present invention there is provided a method of extinguishing hydrogen fires that comprises introducing to the fire a fire extinguishing concentration of an extinguishant composition including 1,1,1,2,3,3,3-Heptafluoropropane (HFC-227ea, $CF_3CHFCF_3$), and maintaining the concentration of the composition until the fire is extinguished. 1,1,1,2,3,3,3-heptafluoropropane may be used alone, or in combination with other fire extinguishants. Blends of 1,1,1,2,3,3,3-heptafluoropropane with other such extinguishants are also contemplated for use.

It is an object of the present invention to provide an effective method for extinguishing hydrogen fires which employs compounds that are environmentally safe, and which have low ozone depletion potential and greenhouse warming effect. A further object of the present invention is to provide fire extinguishing methods for hydrogen fires using compositions comprising blends of 1,1,1,2,3,3,3-heptafluoropropane and other extinguishing agents, which blends are effective and safe in use.

A further object of the present invention is the protection of hydrogen containing hazards with 1,1,1,2,3,3,3-heptafluoropropane. Examples of such hazards include, but are not limited to, petroleum refineries, ammonia synthesis plants, methanol production facilities, cyclohexane, benzene, oxo alcohol and aniline production facilities, metallurgical processing facilities, reduced gas blanketing processes, edible fats and oils production facilities, float glass manufacturing, electronics industry applications, fuel cells, electrolytic cells, hydrogen powered vehicles, and cryogenic and corrosion prevention applications.

In a further aspect of the invention there is provided a method of rendering hydrogen/oxidizer atmospheres inert, i.e., incapable of supporting combustion. It is a further object of the present invention to provide an effective method of producing an atmosphere which does not support the combustion of hydrogen, that is a method of providing inertion of hydrogen/oxidizer mixtures. It is a further object of the present invention to provide an inertion method which employs compounds that are environmentally safe, having low ozone depletion potential and greenhouse warming effect.

Further objects of the present invention will be apparent from the description which follows.

BRIEF DESCRIPTION OF THE DRAWING

FIG. 1 is a diagrammatic view of a cup burner test system used in demonstrating the novel aspects of the present invention.

FIG. 2 is a graph showing the flammability of various combinations of hydrogen/air/HFC-227ea mixtures.

FIG. 3 is a graph showing the flammability of various combinations of hydrogen/air/Halon 1301 mixtures.

DESCRIPTION OF THE PREFERRED EMBODIMENTS

For the purpose of promoting an understanding of the principles of the invention, reference will now be made to preferred embodiments of the invention and specific language will be used to describe the same. It will nevertheless be understood that no limitation of the scope of the invention is thereby intended, such alterations, further modifications and applications of the principles of the invention as described herein being contemplated as would normally occur to one skilled in the art to which the invention relates.

In accordance with the present invention, 1,1,1,2,3,3,3-heptafluoropropane ($CF_3CHFCF_3$) has been found to be an effective extinguishant for hydrogen fires. However, because 1,1,1,2,3,3,3-heptafluoropropane contains no bromine or chlorine, it has an ozone depletion potential of zero. In one aspect, the invention relates to methods for extinguishing hydrogen fires which are improved by using 1,1,1,2,3,3,3-heptafluoropropane alone, or in a blend, as the fire extinguishing agent. The invention also relates to the provision of fire extinguishing compositions comprising blends of 1,1,1,2,3,3,3-heptafluoropropane with other fire extinguishants.

In accordance with the present invention, 1,1,1,2,3,3,3-heptafluoropropane ($CF_3CHFCF_3$) has also been found to be an effective agent for the inertion of hydrogen/air mixtures, i.e., for rendering hydrogen/air mixtures incapable of combustion. In one aspect, the invention relates to methods for inerting hydrogen/air mixtures which are improved by using 1,1,1,2,3,3,3-heptafluoropropane alone or in a blend, as the inerting agent. The invention also relates to the provision of inerting compositions comprising blends of 1,1,1,2,3,3,3-heptafluoropropane with other fire extinguishants.

1,1,1,2,3,3,3-Heptafluoropropane ($CF_3CHFCF_3$) is a halogenated hydrocarbon with a molecular weight of 170 and a boiling point of −16° C. It has been employed as a fire suppression agent for various class fuels, as described in U.S. Pat. No. 5,124,053. However, because 1,1,1,2,3,3,3-heptafluoropropane lacks a bromine atom, it is generally recognized as a much less efficient fire suppression agent compared to Halon 1301, on both a volume and weight basis. For example, the extinguishment of n-heptane diffusion flames requires 3 percent by volume Halon 1301, and 6 percent 1,1,1,2,3,3,3-heptafluoropropane (NFPA 2001 Standard on Clean Agent Fire Extinguishing Systems, NFPA, 1994 edition). Surprisingly, we have found that 1,1,1,2,3,3,3-heptafluoropropane is uniquely superior to Halon 1301 in the suppression of hydrogen fires, on both a volume and weight basis.

In accordance with one embodiment of the present invention, there is provided a method for extinguishing hydrogen fires which includes the use of 1,1,1,2,3,3,3-heptafluoropropane as a fire extinguishing agent. In use with hydrogen fires, 1,1,1,2,3,3,3-heptafluoropropane may be applied in the variety of methods employed for other halogenated hydrocarbons, including application in a flooding system, portable system or specialized system. 1,1,1,2,3,3,3-Heptafluoropropane is effective in lower concentrations than Halon 1301, and of course at higher concentrations as well. The concentration employed may depend to some extent on the circumstances of application. Generally, application rates of 1,1,1,2,3,3,3-heptafluoropropane alone preferably range from at least about 13%, and more preferably between about 15% and 30% v/v.

A further desirable aspect of the present invention is that 1,1,1,2,3,3,3-heptafluoropropane is environmentally safer than many of the prior art halogenated hydrocarbon fire extinguishing agents. 1,1,1,2,3,3,3-Heptafluoropropane has an ODP of zero, compared to an ODP of 10 for Halon 1301 and of 3 for Halon 1211, two common commercial fire extinguishants.

It is also an aspect of the present invention that 1,1,1,2,3,3,3-heptafluoropropane may be employed in use with hydrogen fires with other extinguishants. The resulting blend will have improved characteristics in terms of efficacy, toxicity and/or environmental safety depending on the blend and the application. Among the other agents with which 1,1,1,2,3,3,3-heptafluoropropane may be blended are iodine, chlorine and/or bromine containing compounds such as iodotrifluoromethane ($CF_3I$), Halon 1301 ($CF_3Br$), Halon 1211 ($CF_2BrCl$), Halon 2402 ($BrCFCF_2Br$), Halon 1201 ($CF_2HBr$) and 2-chloro-1,1,1,2-tetrafluoroethane ($CF_3CHFCl$), and hydrofluorocarbons such as trifluoromethane ($CF_3H$), pentafluoroethane ($CF_3CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), and 1,1,1,2,2,3,3-heptafluoropropane ($CF_3CF_2CF_2H$). Where 1,1,1,2,3,3,3-heptafluoropropane of this invention is employed in a blend, 1,1,1,2,3,3,3-heptafluoropropane may be combined, preferably in an amount of from about 1% to about 99% by weight of the blend, with one or more of these compounds. Mixtures of 1,1,1,2,3,3,3-heptafluoropropane with the hydrofluorocarbons are especially preferred because said mixtures have an ODP of zero.

The relative amounts of the 1,1,1,2,3,3,3-heptafluoropropane and other compounds is not critical, but rather is dictated by the characteristics desired for the overall composition. Thus, in certain applications there may be a greater need for low toxicity, and in other instances, the emphasis may be on high efficacy. Therefore, no particular ratios of compounds are required.

The methods for application of the described fire extinguishing compositions are those known to be useful for the Halon agents. In broad terms, these methods utilize application systems which typically include a supply of agent, a means for releasing or propelling the agent from its container, and one or more discharge nozzles to apply the agent into the hazard or directly onto the burning object. Thus, the agents of this invention may be used in total flooding systems in which the agent in introduced into an enclosed region surrounding a fire at a concentration sufficient to extinguish the fire. In accordance with a total flooding system, equipment or even rooms may be provided with a source of agent and appropriate piping, valves and controls so as to automatically and/or manually be introduced at appropriate concentrations in the event that fire should break out. Thus, as is known to those skilled in the art, the fire extinguishant may be pressurized with nitrogen or other inert gas at up to about 500 psig at ambient conditions, and stored in the system as the superpressurized agent. Alternatively, the fire extinguishant may be pressurized with nitrogen or other inert gas at the time of system activation.

Alternatively, the compositions of the invention may be applied to a fire through the use of conventional portable fire extinguishing equipment. It is usual to increase the pressure in portable fire extinguishers with nitrogen or other inert gases in order to ensure that the agent is completely expelled from the extinguisher. 1,1,1,2,3,3,3-Heptafluoropropane containing systems in accordance with this invention may be conveniently pressurized at any desirable pressure up to about 600 psig at ambient conditions, ether prior to or at the time of system activation.

In the case of inerting applications, 1,1,1,2,3,3,3-heptafluoropropane in an amount sufficient to render hydrogen/oxidizer mixtures incapable of combustion may be delivered to the hazard area by any of those means known to those in the industry. Hence a process containing a hydrogen/oxidizer mixture can be permanently padded with 1,1,1,2,3,3,3-heptafluoropropane, or alternatively upon detection of a hazardous mixture of hydrogen/oxidizer, the 1,1,1,2,3,3,3-heptafluoropropane may be delivered to the hazard in sufficient quantities to render the atmosphere incapable of supporting combustion.

It is also an aspect of the present invention that 1,1,1,2,3,3,3-heptafluoropropane may be employed with suppression agents to provide a blend having improved characteristics in terms of efficacy, toxicity and/or environmental safety. Among the other agents with which 1,1,1,2,3,3,3-heptafluoropropane may be blended are iodine, chlorine and/or bromine containing compounds such as iodotrifluoromethane ($CF_3I$), Halon 1301 ($CF_3Br$), Halon 1211 ($CF_2BrCl$), Halon 2402 ($BrCF_2CF_2Br$), Halon 1201 ($CF_2HBr$) and 2-Chloro-1,1,1,2-tetrafluoroethane ($CF_3CHFCl$), and hydrofluorocarbons such as trifluoromethane ($CF_3H$), pentafluoroethane ($CF_3CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), and 1,1,1,2,2,3,3-heptafluoropropane ($CF_3CF_2CF_2H$).

The invention will be further described with reference to the following specific Examples. However, it will be understood that these Examples are illustrative and not restrictive in nature.

EXAMPLE 1

Dynamic extinguishment test data for 1,1,1,2,3,3,3-heptafluoropropane were obtained employing the cup burner test procedure in which air and the agent are continuously supplied to a hydrogen flame produced in a glass cup burner (see FIG. 1).

The apparatus includes a cup 10 having a height 11 of 610 mm and a diameter 12 of 102 mm. Fuel from the reservoir 13 to a burner 14 having a diameter of 28 mm and a height above the top of the mixing chamber 15 of 178 mm. The mixing chamber 15 is 102 mm high and includes beads 16 stacked to a height of 76 mm. Air and fire extinguishant are fed in with rotameters 17 and 18 and lines 19 and 20. In this manner, the air and extinguishant are mixed and diffuse upwardly from the chamber 15 to the flame at the top of the burner 14.

The cup burner apparatus is commonly employed for the evaluation of the relative effectiveness of fire suppression agents, and has been described for example in *NFPA* 2001 *Standard on Clean Agent Fire Extinguishing Systems,* 1994 edition. Vapor of the agent to be tested is mixed with air and introduced to the flame, with the concentration of agent in air being increased slowly until the flow is just sufficient to cause extinction of the flame. Data were obtained in this fashion for 1,1,1,2,3,3,3-heptafluoropropane and for comparative purposes, for Halon 1301. The percent of each agent in air (v/v) required to extinguish hydrogen flames is given in Table 1.

This example demonstrates the superior performance of 1,1,1,2,3,3,3-heptafluoropropane compared to Halon 1301 for the suppression of hydrogen combustion.

EXAMPLE 2

Dynamic extinguishment data were obtained for the extinguishment of diffusion flames of a number of fuels as described in Example 1 for 1,1,1,2,3,3,3-heptafluoropropane and Halon 1301, and the results are also shown in Table 1. This example demonstrates the usually encountered superior performance of Halon 1301 on Class B fuels compared to 1,1,1,2,3,3,3-heptafluoropropane.

By comparison, it is shown that 1,1,1,2,3,3,3-heptafluoropropane has unique and surprising superior efficacy when used with hydrogen fires.

TABLE 1

| | Ext. Concentration, % v/v | |
|---|---|---|
| Fuel | $CF_3CHFCF_3$ | Halon 1301 |
| Hydrogen | 13.2 | 18.3 |
| Acetone | 6.9 | 3.3 |
| AV gas | 6.5 | 3.3 |
| Diesel | 6.7 | 2.1 |
| Diethyl Ether | 7.5 | 3.7 |
| Ethane | 6.7 | 4.4 |
| Ethanol | 8.3 | 3.8 |
| Ethylene | 8.4 | 6.3 |
| Methane | 5.5 | 2.5 |
| Methanol | 10.4 | 7.2 |
| Methyl Ethyl Ketone | 7.4 | 3.5 |
| Propane | 6.7 | 3.6 |

EXAMPLE 3

This example demonstrates the inertion of hydrogen by HFC-227ea. The concentration of HFC-227ea required to inert hydrogen was measured in an 8.0 L explosion sphere, consisting of two 304 stainless hemispheres welded on stainless steel flanges, and equipped with instrumentation allowing the monitoring of pressure and temperature as a function of time. A mixture of hydrogen and air and the desired concentration of HFC-227ea were introduced into the sphere employing partial pressures to determine the volumes of agent, fuel and air. The mixture was then subjected to a DC spark of 70 J ignition energy, located in the center of the sphere. Mixtures producing an overpressure of greater than or equal to 1.0 psia following activation of the spark are considered flammable, and mixtures producing an overpressure of less than 1.0 psia are considered nonflammable. By examining a series of mixtures of varying ratios of hydrogen/air/HFC-227ea, the concentration of HFC-227ea required to inert all combinations of hydrogen and air can be determined. The flammability measurements indicated that 24% by volume of HFC-227ea is required to render all combinations of hydrogen and air nonflammable. The flammability diagram determined from the experimental data is shown in FIG. 2 for the hydrogen/air/HFC-227ea system.

EXAMPLE 4

The method of Example 3 was employed to determine the amount of Halon 1301 ($CF_3Br$) required for the inertion of hydrogen. The flammability measurements indicated that 25% by volume of Halon 1301 was required to render all combinations of hydrogen and air nonflammable. The flammability diagram determined from the experimental data is shown in FIG. 3 for the hydrogen/air/Halon 1301 system.

What is claimed is:

1. A method for treating an atmosphere containing hydrogen and an oxidizer, the hydrogen and oxidizer being present in amounts sufficient to support the combustion of the hydrogen by the oxidizer, the method comprising introducing to the atmosphere a concentration of a composition consisting essentially of 1,1,1,2,3,3,3-heptafluoropropane sufficient to render the atmosphere incapable of supporting combustion of the hydrogen.

2. The method of claim 1 in which the hydrogen is present in an amount of at least about 5 percent by volume of the atmosphere.

3. The method of claim 1 in which the concentration of said heptafluoropropane is in the range from 15 to 75 percent by volume of the atmosphere.

4. The method of claim 3 in which the concentration of said heptafluoropropane is at least about 24 percent by volume of the atmosphere.

5. An atmosphere which does not support the combustion of hydrogen comprising:

a. a combination of an amount of hydrogen and an amount of oxidizer sufficient to support combustion of the hydrogen in the absence of another component rendering the combination non-combustible; and b. 1,1,1,2,3,3,3-heptafluoropropane in a concentration sufficient to render the combination of said heptafluoropropane and said amounts of oxidizer and hydrogen incapable of supporting the combustion of the hydrogen.

6. The atmosphere of claim 5 in which the concentration of said heptafluoropropane is in the range from 15 to 75 percent by volume of the atmosphere.

7. The atmosphere of claim 5 in which the oxidizer is air.

8. The atmosphere of claim 5 in which the oxidizer is oxygen.

9. The atmosphere of claim 5 in which the hydrogen is present in an amount of at least about 5 percent by volume of the atmosphere.

10. An atmosphere which does not support the combustion of hydrogen comprising:

a. a combination of hydrogen in air, the hydrogen being present in the air in an amount sufficient to support combustion of the hydrogen by the air in the absence of another component rendering the combination non-combustible; and b. 1,1,1,2,3,3,3-heptafluoropropane in a concentration sufficient to render the combination of said heptafluoropropane and said amounts of air and hydrogen incapable of supporting the combustion of the hydrogen.

11. The atmosphere of claim 10 in which the hydrogen is present in an amount of at least about 5 percent by volume of the atmosphere.

12. The atmosphere of claim 10 in which the concentration of said heptafluoropropane is in the range from 15 to 75 percent by volume of the atmosphere.

13. The atmosphere of claim 12 in which the concentration of said heptafluoropropane is at least about 24 percent by volume of the atmosphere.

* * * * *